US005159791A

United States Patent [19]

Juhas

[11] Patent Number: 5,159,791

[45] Date of Patent: Nov. 3, 1992

[54] MODULAR STRUCTURAL ROOFING AND WALL SYSTEM

[76] Inventor: William M. Juhas, 2604 Ninth St., Cuyahoga Falls, Ohio 44221

[21] Appl. No.: 322,294

[22] Filed: Mar. 13, 1989

[51] Int. Cl.[5] ..... E04B 7/02

[52] U.S. Cl. ..... 52/90; 52/228; 52/585

[58] Field of Search ..... 52/228, 585, 535, 536, 52/82, 81, 80, 780, 781

[56] References Cited

U.S. PATENT DOCUMENTS

| | | | |
|---|---|---|---|
| 1,825,195 | 9/1931 | McAvoy et al. | 52/204 |
| 2,883,711 | 4/1959 | Kump | 52/780 |
| 3,173,226 | 3/1965 | Solnick | 52/228 |
| 3,683,569 | 8/1972 | Holm | 52/780 |
| 4,294,051 | 10/1981 | Hughes, Jr. | 52/228 |

*Primary Examiner*—Michael Safavi
*Attorney, Agent, or Firm*—Renner, Kenner, Greive, Bobak, Taylor & Weber

[57] ABSTRACT

A modular, pre-insulated, pre-finished, structural roofing and wall system. The roofing system incorporates common and varying sizes of roofing panels that fasten to one another through structural support members in the assembly of a roof, and which may be unfastened from each other in disassembly. The roofing system further incorporates fastening components that attach the roofing system to adjoining walls, and may include electrical boxes and wiring conduits attached to and within selected roofing panels. The roofing system may also be utilized in the construction of suspended flooring systems. The wall system is pre-insulated, pre-finished, and self sealing.

13 Claims, 11 Drawing Sheets

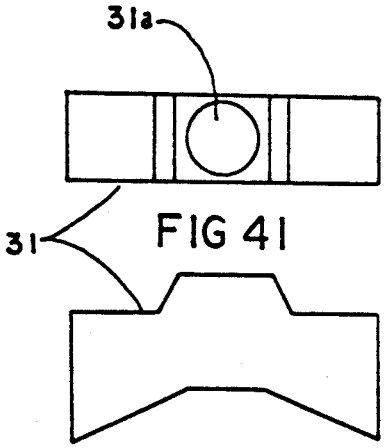
FIG 41
FIG 43
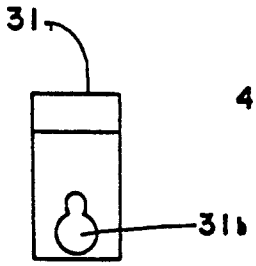
FIG 42
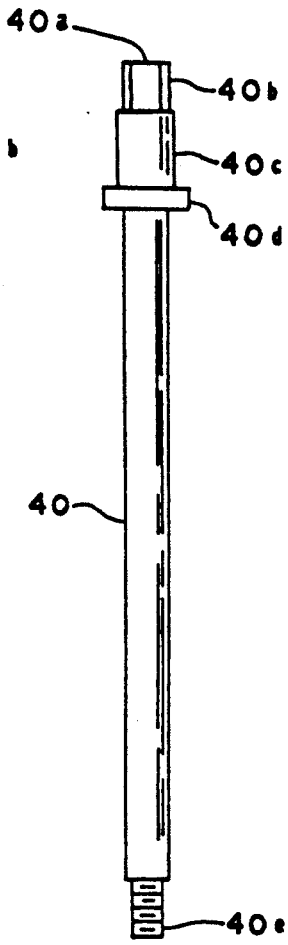
FIG 49
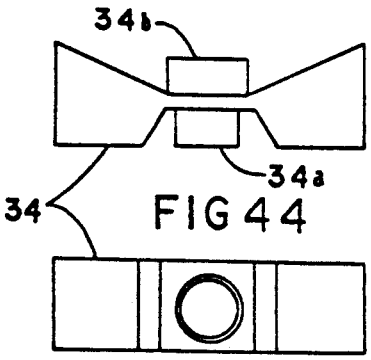
FIG 44
FIG 45
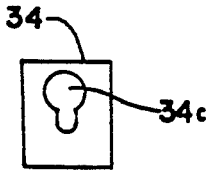
FIG 46
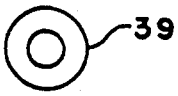
FIG 47
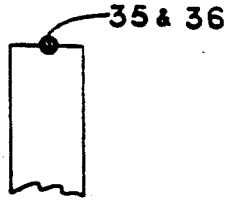
FIG 50
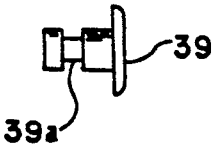
FIG 48
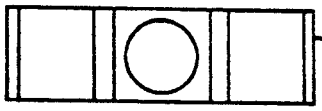
FIG 51
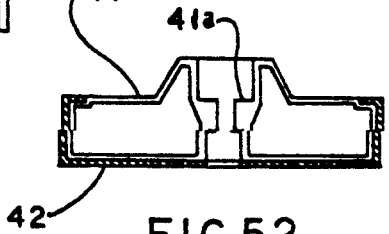
FIG 52
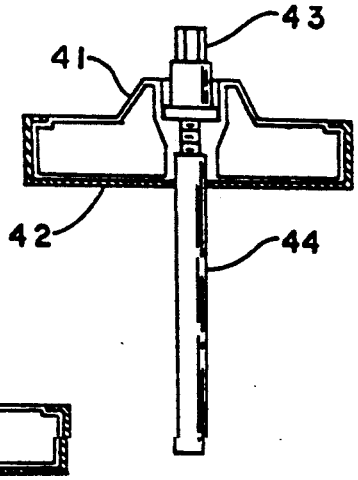
FIG 53

MODULAR STRUCTURAL ROOFING AND WALL SYSTEM

TECHNICAL FIELD

The invention herein resides in the art of building construction and, more particularly, to prefabricated modular construction of roof, floor, and wall assemblies.

BACKGROUND ART

Since the energy crisis of the early 1970's, most residential and commercial buildings have been constructed utilizing energy conserving materials, while existing buildings have added insulation. Although these measures have reduced the energy required to heat and cool these structures, these measures have also dramatically increased initial material and labor costs, as well as construction time to build these structures. This invention relates to an improved highly insulated building material of modular design that can be quickly assembled into a quality roofing system, by unskilled labor, utilizing only small hand tools, and thereby reducing construction costs and construction time.

The prior art of roof construction consists mainly of flat or pitched roofs built upon wood or steel joists. Decking of wood planks, plywood, or metal is generally affixed to the joists and insulation is applied upon or below the decking material. Waterproofing materials such as asphalt, rubber, tar and gravel, metal, clay, or other suitable material is then applied atop the decking composition to weatherproof the roofing structure. These types of roofing structures are very labor intensive, requiring several different crafts to construct. Such construction entails significant expenditures of both time and money. Further, depending upon the roofing insulation utilized, thermal voids are often found in non-rigid insulation materials such as battens or blown-in materials, taking away from the efficiency of the insulation.

The prior art with respect to pre-insulated manufactured by sandwiching rigid foam insulation between sheets of metal or wood. Normally, sandwich panels of this type require heavy equipment to set the panels in place for subsequent attachment to field constructed roof joists. This type of construction also requires time consuming attachment methods to secure the sandwich panels to the roof joists. These sandwich panels further require the field installation of weather proofing materials after the panels are set in place.

Other types of modular roofing construction consist of prefabricated panels set between strips of thin metal that act as alignment members between adjacent panels. This type of construction limits the length of a desired roof span between walls, and also creates thermal bridges from the exterior to the interior of the building by way of the metal strips.

While the prior art has taught prefabricated modular wall construction, such as in prior U.S. Pat. No. 4,694,624, there is a need in the art for a modular prefinished structural roofing system comprised of pre-insulated roofing panels, prefabricated structural support members, facing elements of selected materials affixed to the roofing panels, and fastening rods for the attachment of the roofing panels to each other and to other roofing components. There is a further need for a pre-insulated roofing panel of varying sizes and shapes that is comprised of two parallel panel elements, facing elements, an insulating element, panel support elements, panel retainers, conduits for fastening rods, and fastening rods. The art has also been devoid of a roofing system of interposed structural support members of varying sizes and shapes that are comprised of structural elements, conduits for fastening rods, and wall attachment fixtures.

Further, while the prior art of U.S. Pat. No. 4,694,624 teaches a modular pre-insulated, pre-finished building block, there has been found a need to increase the compressive and shear strength of the building block, to provide the building block with a perimeter that is self sealing against wind and rain when placed adjacent to other building components, and to provide an improved method of anchoring a modular wall to a foundation.

DISCLOSURE OF INVENTION

In light of the foregoing, it is a first aspect of the invention to provide a structural roofing system that is highly insulated.

Another aspect of the invention is to provide a structural roofing system that can be erected manually by one or two persons without the use of heavy equipment.

A further aspect of the invention is to provide a structural roofing system that can be erected by using only small hand tools.

An additional aspect of the invention is to provide a structural roofing system that can be easily assembled by unskilled workers, and to provide a structural roofing system that can be assembled, disassembled, and then reassembled with little or no damage to the weatherproofing materials affixed to the roofing panels.

Yet a further aspect of the invention is to provide a structural roofing system that does not require on-the-job cutting or adaptation of the roofing components.

Another aspect of the invention is to provide a structural roofing system with roofing panels that incorporate contoured edged that abut to the contoured shapes of adjoining roofing panels and structural support members.

Still a further aspect of the invention is to provide a structural roofing system with roofing panels that incorporate electrical boxes, utility boxes, and wiring conduits premounted into selected roofing panels, and to provide a structural roofing system which incorporates nailer strips for the attachment of ceiling or flooring materials where required.

An additional aspect of the invention is the provision of a modular pre-insulated, pre-finished building block having increased compressive and shear strength.

Yet a further aspect of the invention is the provision of a modular pre-insulated, pre-finished building block which is self sealing against wind and rain.

Still another aspect of the invention is the provision of a modular pre-insulated, pre-finished building block which may be readily anchored to a foundation.

The foregoing and other aspects of the invention which will become apparent as the detailed description proceeds are achieved by a roofing system, comprising: a plurality of aligned support members in spaced apart relation to each other; and a plurality of roof panels received between adjoining support members, each said roof panel comprising: a top panel; and a bottom panel spaced from and parallel to said bottom panel and overhanging said top panel along parallel sides thereof, said top and bottom panels being of the same length and longitudinally offset with respect to each other.

Other aspects which will become apparent herein are achieved by a roofing system comprising: a plurality of aligned support members, each having support elements extending longitudinally therealong; a plurality of roof panels maintained between aligned pairs of said support members and supported by said support elements; and fastening rods interconnecting roof panels maintained between a first aligned pair of support members with roof panels maintained between second and third aligned pairs of support members on either side of said first aligned pair of support members.

Yet additional aspects of the invention are attained by a structural building block, comprising: a pair of spaced apart parallel face pieces; a pair of retainers securing said face pieces in said parallel spaced apart relation, each said retainer being secured to each of said face pieces by a fastener; and a fastening rod conduit maintained between said pair of retainers for receiving a fastening rod therethrough for securing the building block to other similar building blocks.

BRIEF DESCRIPTION OF DRAWINGS

FIG. 41 is a plan view of an upper structural element retainer as used in the invention;

FIG. 42 is an elevation of the upper structural element retainer in FIG. 41 as viewed from the end;

FIG. 43 is an elevation of the upper structural element retainer shown in FIG. 41 as viewed from the side;

FIG. 44 is an elevation of a lower structural support retainer to the invention;

FIG. 45 is a plan view of a lower structural element retainer as shown in FIG. 44;

FIG. 46 is an elevation of a lower structural element retainer as shown in FIG. 44 as viewed from the end;

FIG. 47 is a plan view of an element retainer fastener of the

FIG. 48 is an elevation of a element retainer fastener shown 47 as viewed from the side;

FIG. 49 is an enlarged elevation of a fastening rod according to the invention;

FIG. 50 is a partial enlarged section of a structural element of the invention with an elastomer seal attached;

FIG. 51 is a plan view of an anchor plate retainer of the invention;

FIG. 52 is a section of an anchor plate retainer mounted /within an anchor plate as viewed from the side; and FIG. 53 is a section of an anchor plate retainer as shown in FIG. 52 with an anchor bolt attached.

BEST MODE FOR CARRYING OUT THE INVENTION

Figure 1:
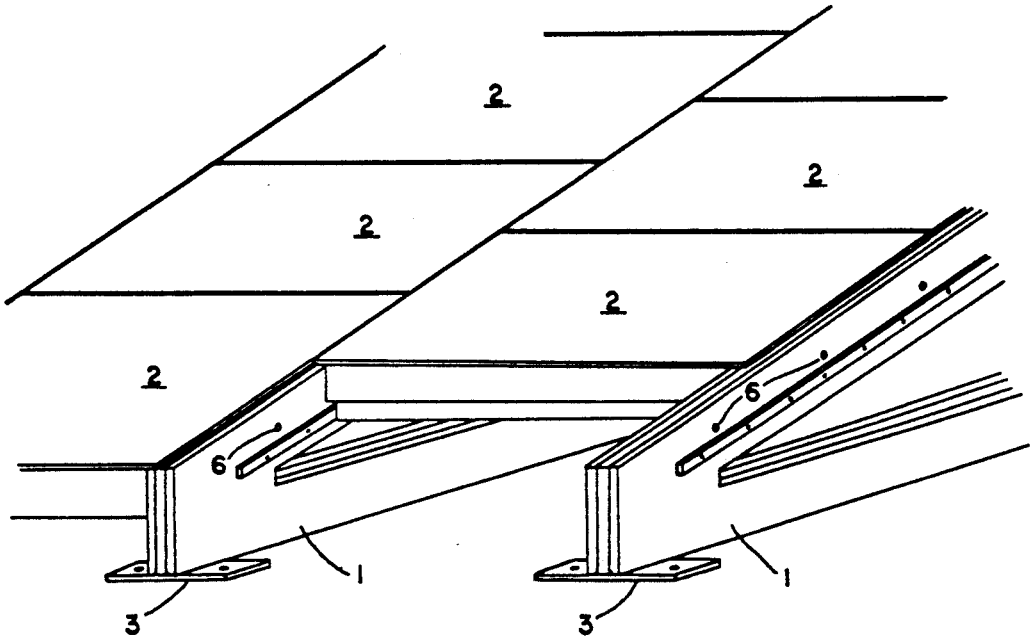
FIG. 1 is a partial perspective view of a pitched roofing assembly.
Figure 2:
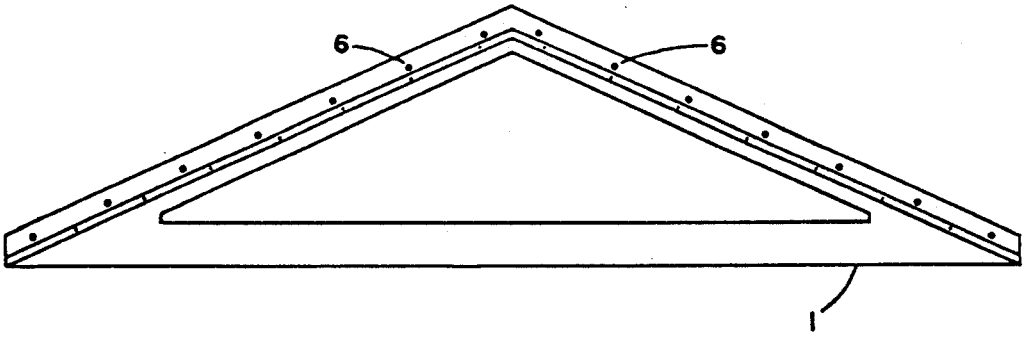
FIG. 2 is an elevation of a structural support member for a pitched roof.
Figure 3:
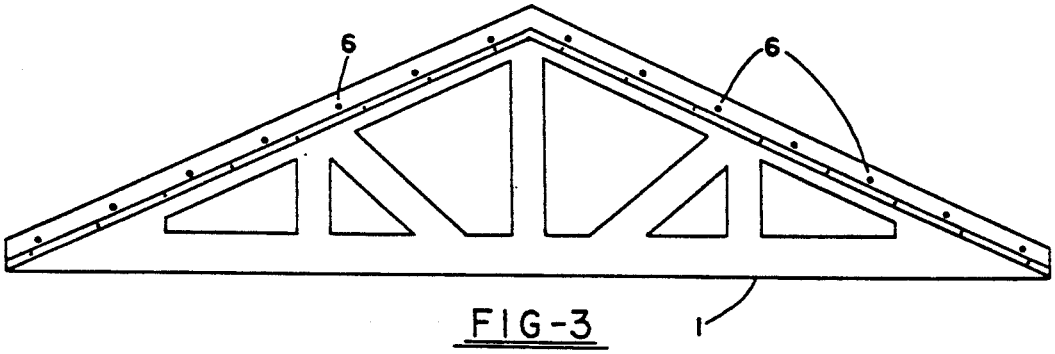
FIG. 3 is an elevation of a structural support member for a pitched roof incorporating internal supports.
Figure 4:
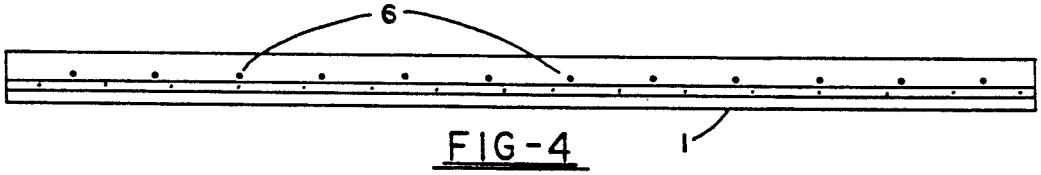
FIG. 4 is an elevation of a structural support member for a flat,.roof.

Referring now to the drawings, it can be seen that FIG. 1 illustrates a modular structural roofing system comprised of structural support members 1 receiving insulated roofing panels 2 and having wall attachment fixtures 3 at ends thereof for securing engagement with vertical supports. Structural support members 1, as shown in FIGS. 2, 3 and 4, may be constructed to conform to various roof pitch lines and roof loadings. As illustrated, the structural support member 1 as shown in FIG. 2 is for a pitched roof and is absent any internal supports. The structural member shown in FIG. 3 includes such internal supports, comprising a truss structure, to support heavier loads. Finally, the structural support member 1 shown in FIG. 4 is for a flat roof construction or, indeed, could be used as a floor. While the structural support members 1 can be of various pitches and load ratings, it is preferred that the material composition of such support members is of plywood and wafer board, or a combination of steel and plywood. Again, the specific structural features will be a function of the desired load rating.

Figure 10:
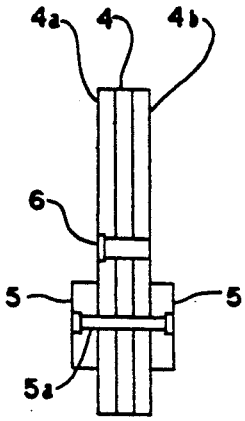
FIG. 10 is a cross section of a structural support member.
Figure 11:
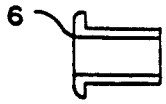
FIG. 11 is a cross section of a structural support member fastening rod conduit.

As illustrated in FIGS. 6, 9, 10 and 14, the nominal structural support member 1 comprises a center layer 4 sandwiched between outer layers 4*a* and 4*b* with side panel support elements 5 on each of opposite sides thereof. In the preferred embodiment, the center layer 4 is ½" plywood, the outer layers 4*a*, 4*b* are ½" wafer board, and the panel support elements 5 are strips of ½" plywood, cut to a height of 1 ½" and extending substantially the full length of the structural support member. As shown in FIGS. 10 and 11, a conduit 6, adapted for receiving a fastening rod, is installed through the sandwich layers 4, 4*a*, 4*b* of the structural support member.

Figure 12:
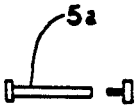
FIG. 12 is a side view of a structural support member element retaining pin.
Figure 14:
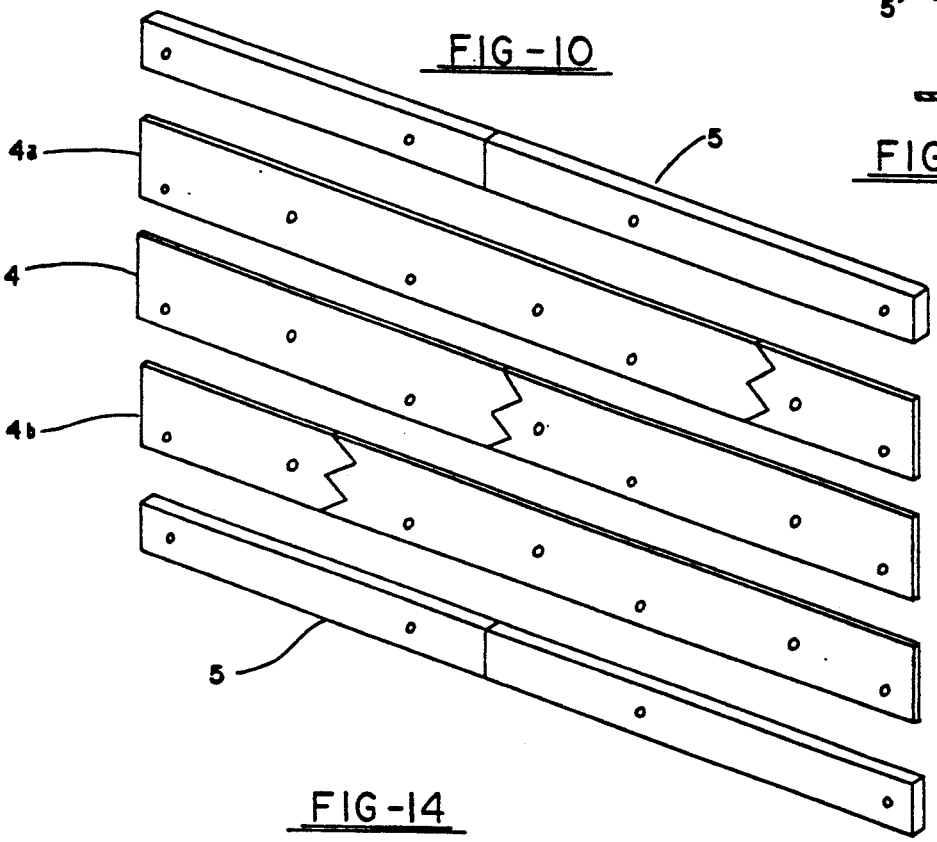
FIG. 14 is a partial exploded isometric view of a section of a structural support member.

As will be appreciated by those skilled in the art, the height of the structural support member 1 is dependent upon the roof pitch and span. To add strength and rigidity, the layers 4, 4*a*, 4*b* are glued and stapled together. The desired length of the structural support member 1 is constructed by sawing 8'× 4' plywood and wafer board sheets the required height, typically 6" or greater, and splicing the cut boards to the desired length and shape. As illustrated in FIG. 14, the ends of the plywood layers 4 and wafer board layers 4*a*, 4*b* are cut into finger joints and are joined together. The spliced joints of the various layers 4, 4*a*, 4*b* are staggered to maintain structural integrity. As shown throughout the drawings, the panel support elements 5 are attached to the layered structural support member comprising the sandwiched layers 4, 4*a*, 4*b*, by gluing, stapling, screwing, or pinning. A suitable pin 5*a* is shown in FIG. 12, and in implementation in FIG. 10.

The panel support elements 5 are preferably located 3 7/16" down from the top of the structural support member 1 and are parallel with the top of such structural support member. One inch diameter holes are drilled through the layered structural support member every 2' at a preferred distance of 2 ½" from the top of the structural support member. Fastening rod conduits 6, as illustrated in FIGS. 10 and 11, are pressed into the 1" diameter drilled holes. Preferably, the conduits 6 are injection molded of plastic, or formed of stamped metal. As will become apparent later, the conduits 6 receive fastening rods for securing together the various roofing panels 2.

Figure 13:
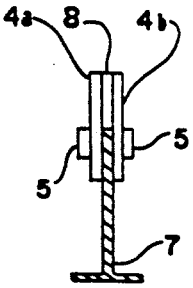
FIG. 13 is an end view of a combination steel and wood structural support member.

As illustrated in FIG. 13, the structural support member may be constructed of a combination of steel and wood. A steel "T" section 7 may be utilized as the center layer of a structural support member, as shown. Outer layers 4*a*, 4*b*, of plywood and/or wafer board, are attached to the steel section 7 by bolts or the like. Panel support elements 5 are attached to the outer layers 4*a*, 4*b*, as described above. A plywood or wafer board filler 8 is installed between the outer layers 4*a*, 4*b* and directly above the steel section 7, such that the top edges of the layers 4*a*, 4*b*, 8 are flush with each other. As will be appreciated by those skilled in the art, the wood filler 8, maintained above the steel 7, eliminates any thermal bridge which would exist between the exterior of the building to the interior of the building if the steel were allowed to extend to the roof line. It will also be appreciated by those skilled in the art that the steel section 7 would typically have a height and thickness determined by the roof pitch, span, and load-bearing characteristics. It will also be appreciated that the desired length of the steel section 7 may be accomplished by welding various lengths of steel plate together.

Figure 5:
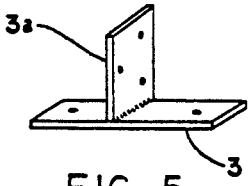
FIG. 5 is an isometric view of a typical wall attachment fixture.
Figure 7:
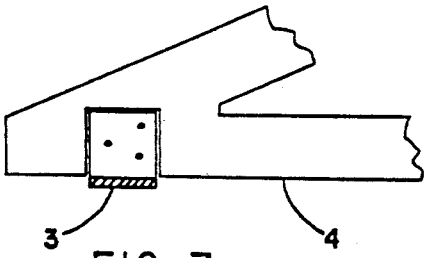
FIG. 7 is a partial cross section of a structural support member with a wall attachment fixture shown in section;/
Figure 6:
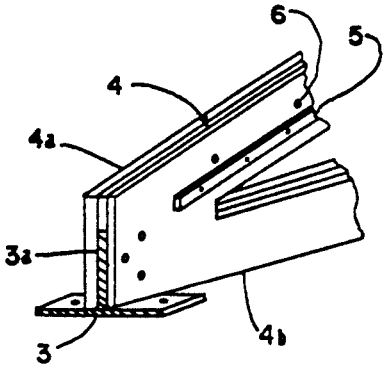
FIG. 6 is an isometric view of a wall attachment fixture incorporated into a structural support member.
Figure 8:
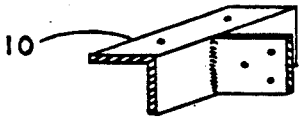
FIG. 8 is a isometric view of a wall attachment hanger fixture.
Figure 9:
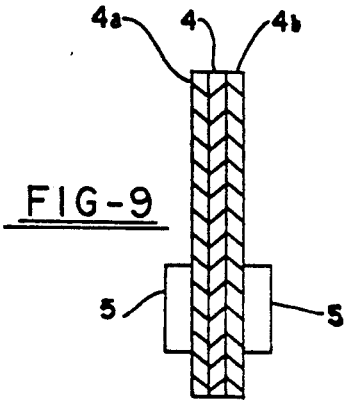
FIG. 9 is an end view of a structural support

As shown in FIGS. 1, 6 and 7, the ends of the structural support members 1 may be bolted to a mounting fixture 3 for receipt of the structural support member 1 upon a vertical support means. A portion of the center layer 4 of the structural support member 1 is omitted to allow for the placement of the mounting fixture 3*a* between the layers 4*a*, 4*b* of the structural support member, as shown in FIG. 6. Preferably, three ⅜" diameter holes are pre-drilled in the mounting fixture 3*a* and the layers 4*a*, 4*b*. The entire assembly is then bolted together. The mounting fixtures are then attached to a load bearing wall on appropriate center lines, for example 4-foot. The mounting fixtures, as illustrated in FIGS. 5 and 8, are steel plates welded in the configurations shown. Wood fixtures could, of course, also be constructed and utilized. The thickness of the plate 3*a*, fastened within the structural support member, is equal to the thickness of the center layer 4 of the structural support member. The height of the raised portion of the mounting fixture 3*a* is ¾ of the height of the adjacent layer 4*a* or 4*b* of the structural support member. However, it will be appreciated by those skilled in the art that the thickness of the materials used, the attachment methods used, and the location of certain elements and parts may be varied.

Referring now to FIGS. 15–20, an insulated roofing panel according to the invention can be seen. Such roofing panels are comprised of two parallel panel elements 11, 12, sandwiching and insulating element 14 therebetween. Side elements 15 are over hung by side support members 13, the purpose of which will be apparent hereinafter. FIGS. 21–24 show the internal construction of the roof panels of FIGS. 15–20. As illustrated, a plurality of panel element retainers 17 extend between the parallel panel elements 11, 12 and are interconnected therebetween by appropriate fastener 16. Passing through the panel element retainers 17 are fastening rod conduit assemblies 20, received by conduit retainers 18, 19 in the side panel elements of 13, as shown.

Figure 15:
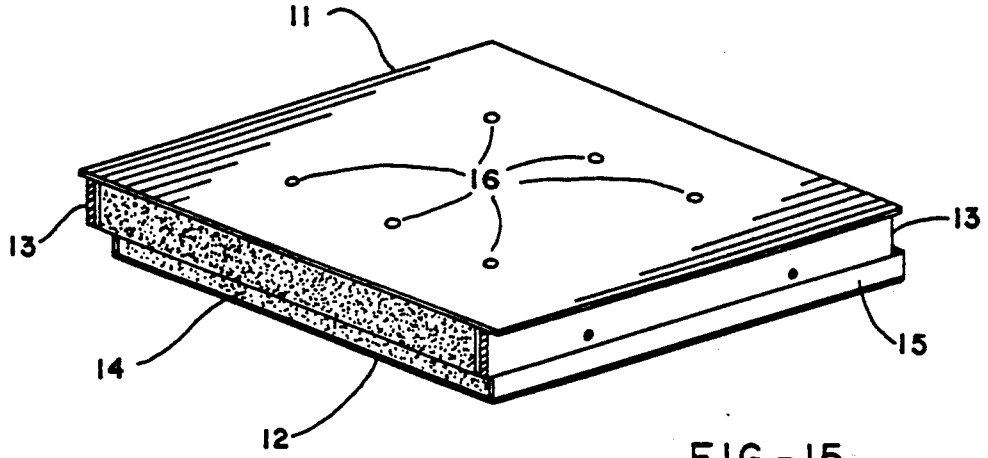
FIG. 15 is a top isometric view of a roofing
Figure 16:
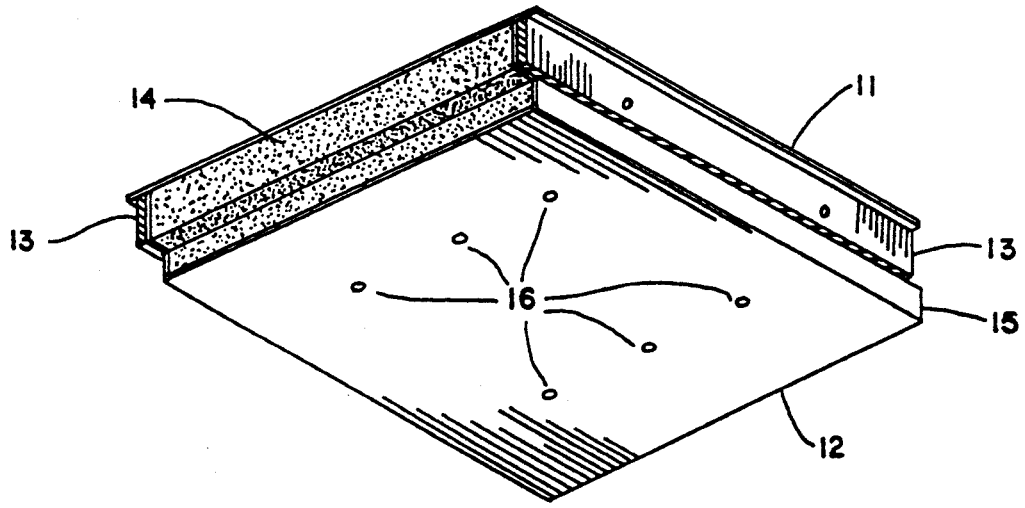
FIG. 16 is a bottom isometric view of the roofing panel shown in FIG. 15.
Figure 17:
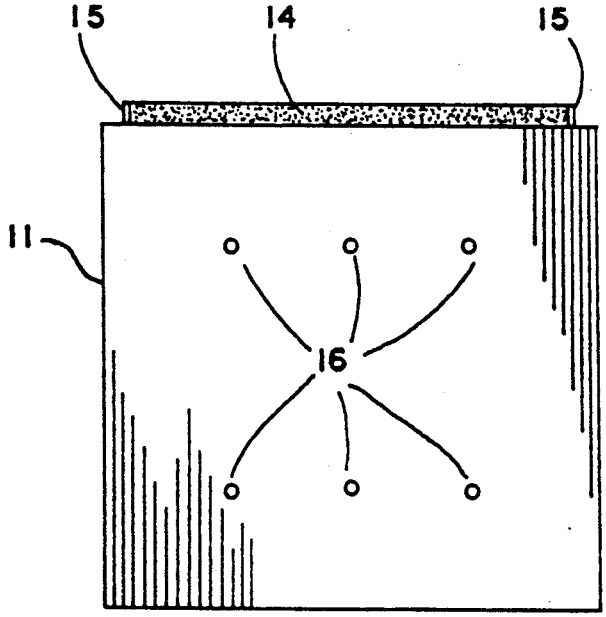
FIG. 17 is a top view of the roofing panel shown in FIG. 15.
Figure 20:
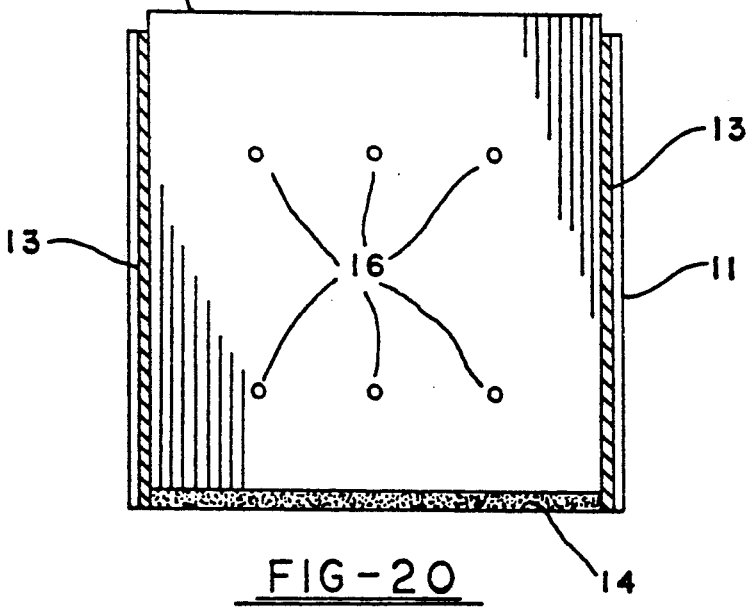
FIG. 20 is a bottom view of the roofing panel shown in FIG. 15.
Figure 21:
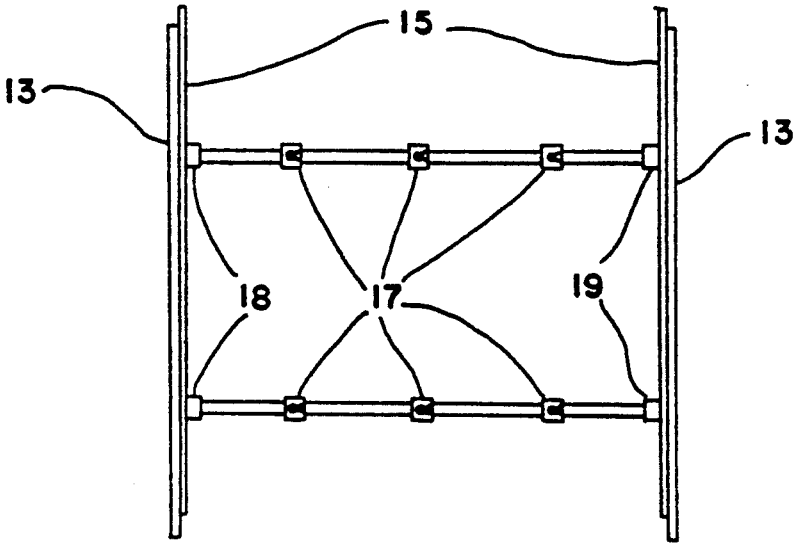
FIG. 21 is a partial section of a roofing panel as viewed from the top.
Figure 22:
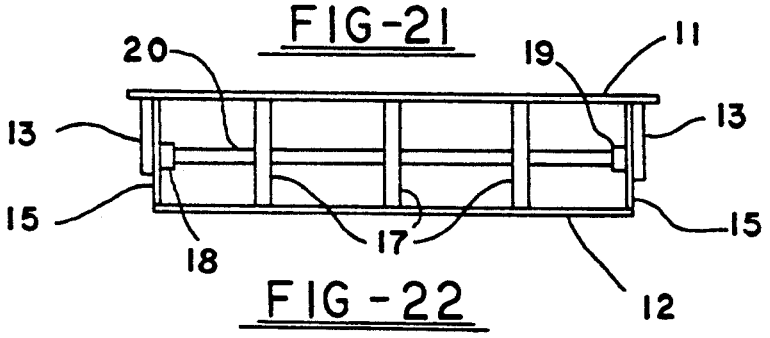
FIG. 22 is a partial section of a roofing panel as viewed from the end.
Figure 23:
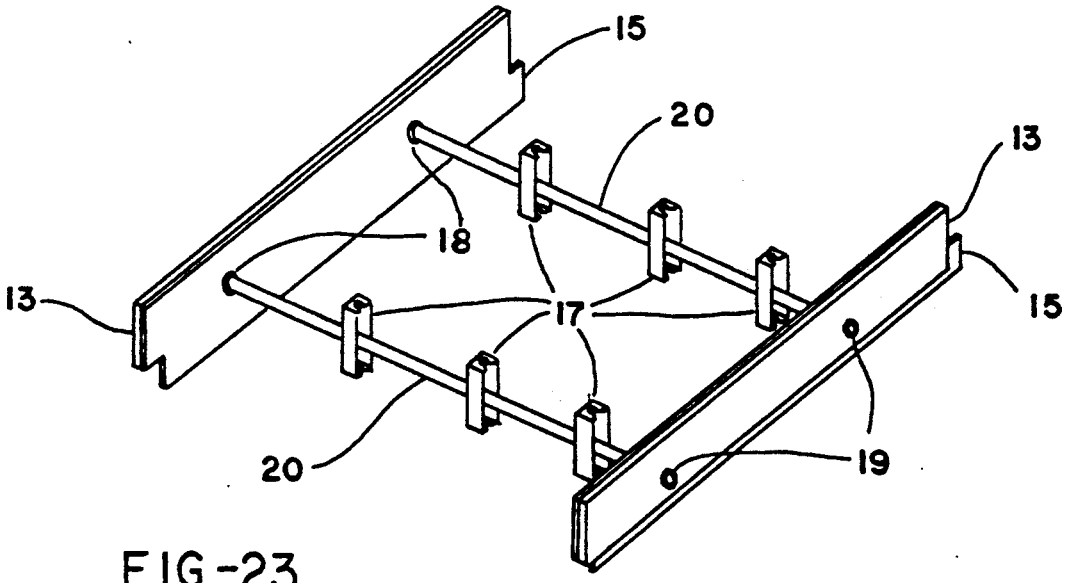
FIG. 23 is a partial section of a roofing panel as viewed in a top isometric configuration.

FIGS. 15 and 17 illustrate a top view of the roofing panel, while FIGS. 16 and 20 illustrate a bottom view of the same. The top panel element 11 is preferably 47 ¼" wide by 47 ⅞" long, while the bottom panel element 12 is 46 ¼" wide by 47 ⅞" long. The panel element material is ½" plywood, wafer board, or other suitable material. As illustrated in side view in FIG. 18, the top panel element 11 and bottom panel element 12 are placed in an offset position such that the upper portion of a roofing panel overlaps the lower portion of an adjoining roofing panel by 1 ½". The side elements 15 are ½" plywood, cut to conform to the offset configuration. The top panel element 11 and bottom panel element 12 are attached to the side elements 15 by gluing and stapling. The height of the side elements 15 is preferably 4". Side support members 13 are attached to the side elements by gluing and with wood screws. The side support members 13 are ½" thick by 2 ½" high by 47 ⅞" long.

Figure 19:
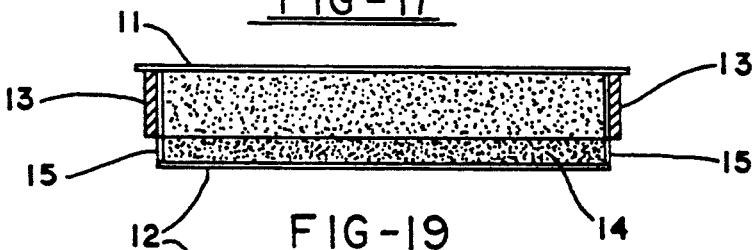
FIG. 19 is a end view of the roofing panel shown in FIG. 15.
Figure 32:
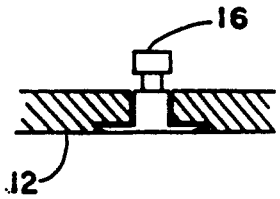
FIG. 32 is a section of a panel element retainer fasten installed in a panel element.
Figure 31:
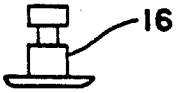
FIG. 31 is a side view of a panel element retainer fastener.

The side support members 13 are attached to the side elements 15 directly below the top panel element 11, as illustrated in FIG. 19. Six holes are drilled into the panel element 11, preferably in a symmetrical configuration and arrangement. The holes are preferably ½" in diameter, with a ⅞" diameter counterbore around the holes to a depth of approximately ⅛". The bottom panel element 12 is likewise drilled and bored symmetrical with the location of the holes in the upper panel element 11. In other words, the six holes in each of the panels 11 and 12 are in registration with each other. Retainer fasteners 16, as illustrated in FIG. 31, are pressed into the holes so drilled and bored in the panel elements 11, 12. FIG. 32 illustrates the positioning of a retainer fastener 16 received by counter-bored hole within the panel element 12.

Figure 18:
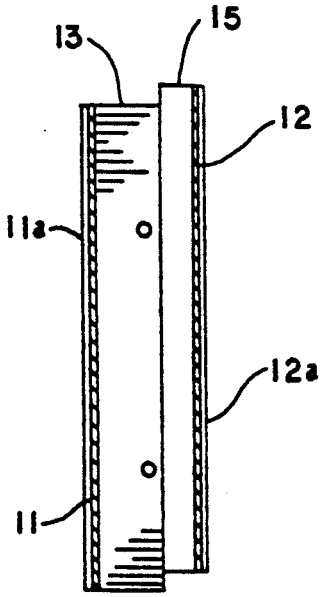
FIG. 18 is a side view of the roofing panel shown in FIG. 15.
Figure 24:
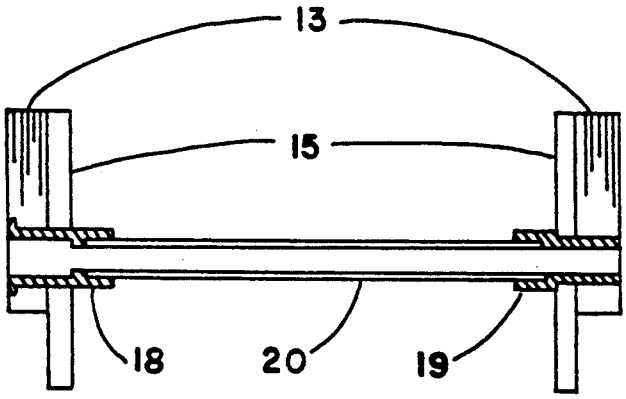
FIG. 24 a section of a fastening rod conduit assembly within a roofing panel.
Figure 30:
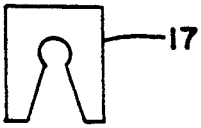
FIG. 30 is an end view of the panel element retainer as shown in FIG. 28.
Figure 35:
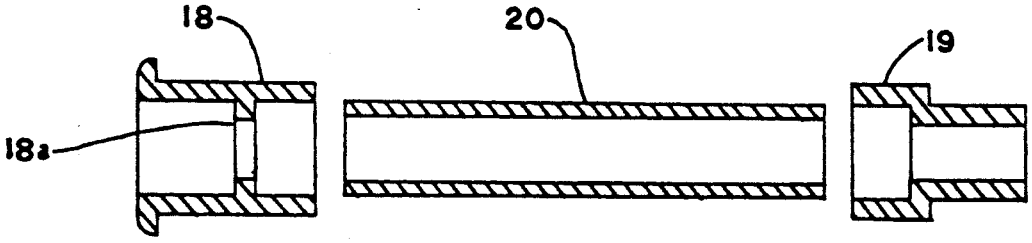
FIG. 35 is an exploded sectional view of a fastening rod conduit.

Retainer fasteners 16, preferably of injection molded plastic, or stamped metal, protrude ½" inside the interfacing of the panel elements 11, 12. The retainer fasteners 16 fasten to panel element retainers 17 through a self-locking clasp located on the ends of the panel element retainers as shown in FIG. 30. These panel retainer elements 17, as shown in FIGS. 28, 29, 30, 21, 22 and 23 are thermally injected molded plastic. The length of each panel element retainer 17 is 4". Of course, the length of the retainer may be increased for thicker roof panels, or decreased for thinner ones. The width and height of the retainer is preferably 1" × 1". The ⅞" diameter hole 17*a*, in the center of the retainer 17, is adapted to accept a conduit 20 which, in turn, receives a fastening rod In addition to side elements 13, panel elements 11, 12 are fastened together through retainer fastener 16 and panel element retainers 17. Two 1" diameter holes are drilled into side elements 15 and side support members 13 as illustrated in FIG. 18. The holes are located on the longitudinal center line of the side element and alignment with the retainer fasteners 16 maintained in panel elements 11, 12. Thermally injected molded plastic or stamped metal conduit retainers 18, illustrated in FIGS. 24, 35, are pressed into the holes drilled in the left side element 15. Similarly, conduit retainers 19, illustrated in FIGS. 24, 35, are pressed into the holes drilled into the right side element 15. Both conduit retainers 18, 19 are 1 ¼" long and protrude ½" inside the roofing panel assembly. During assembly, a ¾" O.D. × ½" I.D. × 45 ¼" long plastic or metal pipe 20, as shown in FIGS. 24, 35, is passed through holes 17*a* of the panel element retainers and is inserted in the protruding section of conduit retainers 18, 19. The entire conduit assembly 18, 19, 20, located within the roofing panel, allows for a fastening rod to be installed through the roofing panel and correctly positions the fastening rod within the roofing panel.

With the conduit assembly 18, 19, 20, and the panel element retainers 17 in place, an insulating material 14, as illustrated in FIGS. 16, 17, 19, 20, is poured into place in the form of polyurethane foam having a density of two pounds per square foot. Preferably, during the manufacturing process, a removable mold encompasses the entire roofing panel, the insulating foam is injected as a liquid into the mold cavity by either pouring or spraying, and the foam material is allowed to rise and expand to all areas of the mold. Of course, it will be understood by those skilled in the art that the density of the polyurethane foam can be higher or lower than that stated, and the insulating material itself can be of other compositions or may even be of sheet or board composition, cut and glued into position.

Figure 25:
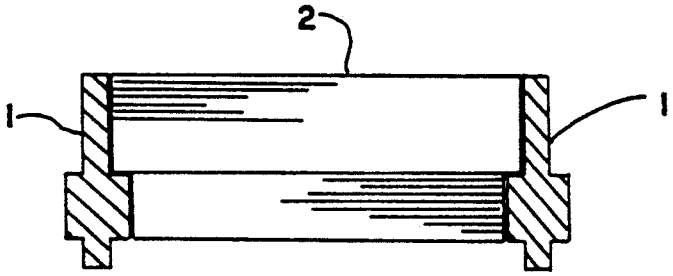
FIG. 25 is a section of a roofing panel installed structural support members.
Figure 33:
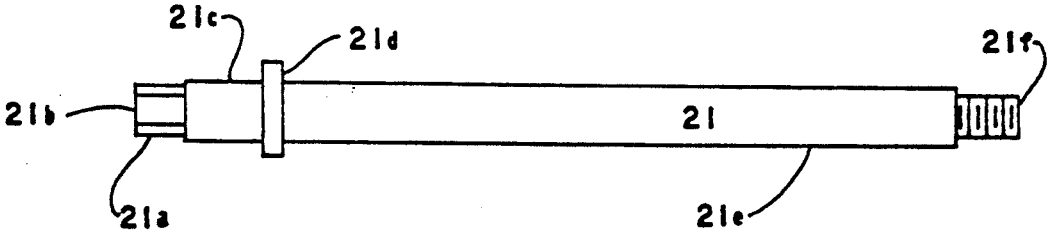
FIG. 33 is a side view of a fastening rod.

With the roofing panels constructed as presented above, they are placed between structural support members 1 as illustrated in FIGS. 1, 25. Side support members 13, attached to the roofing panels 2, are set upon adjoining panel support elements 5, attached to the structural support elements 1. Fastening rods 21, as illustrated in FIG. 33, are inserted into each insert 6 located in the structural support members, and through the fastening rod conduits assemblies 18, 19, 20, located within the roofing panels. The fastening rod is steel or plastic. The top of the bolt 21*a* is a ½" hex head with a centered ⅜" × 16 threaded section 21*b* machined into the head of the rod to a depth of ¾". A 9/16" diameter rod section 21*c* leads from the hex head a distance of ¾" to a shoulder or washer 21*d*. The washer 21*d* is 13/16" diameter and 3/16" thick. The remainder of the body 21*e* is ⅜" diameter × 47" long, with a ⅜" × 16 × ½" long threaded end 21*f*. Of course, it will be appreciated that the dimensions just given can be varied within the confines of the concept of the invention.

Figure 34:
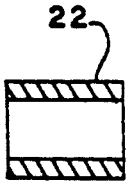
FIG. 34 is a side section of a fastening rod retainer.

In use, when the fastening rod is tightened, the lower portion of washer 21*d* shoulders onto ring 18*a* located in insert 18. The farthest left structural support member 1 is attached to the fastening rods with ⅜" diameter threaded nuts. Subsequent roofing panels and structural support members are fastened to each other by inserting the threaded end of a fastening rod 21*f* into the threaded head of an adjoining fastening rod and tightening. A fastening rod retainer 22, illustrated in FIG. 34, slips over the head of each fastening rod and rests against the top portion of the washer 21*d*. This retainer has 3/16" diameter, is 1 ¼" long, and is made of plastic. The purpose of this retainer is to prohibit fastening rods, other than a specific fastening rod being attended to, from being unscrewed from another during the disassembly of a roofing system.

In the event a fastening rod, other than a specific rod being unscrewed, in a series of connected rods begins to unscrew from its intended position, the fastening rod retainer 22 will prevent the unspecified rod from unscrewing more than one or two turns. As the unspecified rod unscrews, retainer 22 lodges itself between the top of retainer washer 32*d* on the fastening rod and conduit retainer 19 of the adjacent roofing panel, and therefore prevents further travel.

Figure 26:
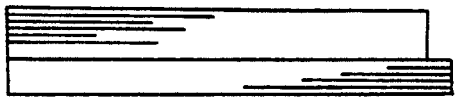
FIG. 26 is a side section of a roofing panel with an angular end.
Figure 27:
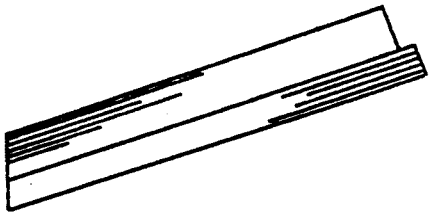
FIG. 27 is a side section of a roofing panel with a square end.
Figure 28:
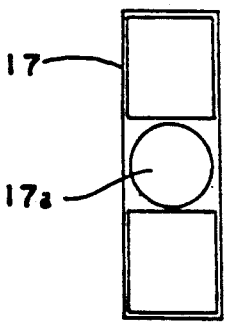
FIG. 28 is a top view of a panel element retainer.
Figure 29:
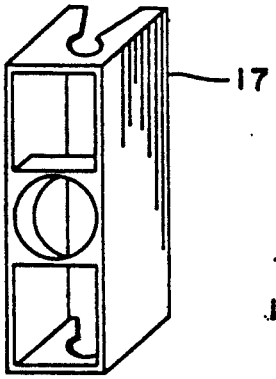
FIG. 29 is an isometric view of the panel element retainer a in FIG. 28.

As shown in FIG. 1, the center line of any given roofing panel will be in line with the seam created by joining two panels together to the right and left sides respectively of any given roofing panel. Of course, such alignment of roofing panels may be varied. The ends of the roofing panels may be altered to eliminate the offset configuration and conformed to a straight edge or roof pitch as illustrated in FIGS. 26, 27. The size and shape of a roofing panel may also be altered to conform to a specific roof configuration. It will also be appreciated that the concept of the invention is not limited to the dimensions set forth herein with respect to the preferred embodiment of the discussion.

Figure 36:
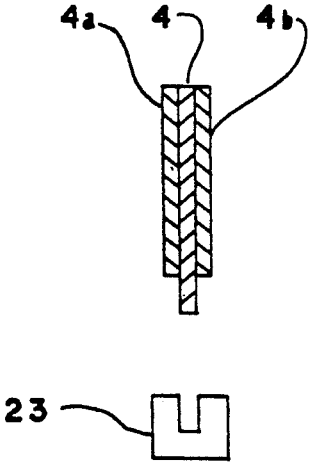
FIG. 36 is a partial exploded view of a modified st member with a nailer strip.
Figure 37:
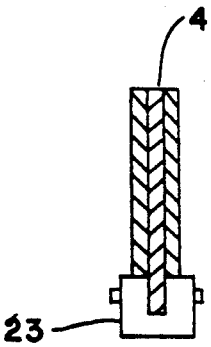
FIG. 37 an end view of a modified structural support member low nailer strip.
Figure 38:
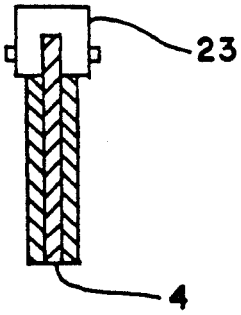
FIG. 38 is an end view of a modified structural support member a high nailer strip.

The structural support members may be altered to accommodate a structural flange or nailer strip. The center layer 4 of a structural support member may be extended below or above the two outer layers of wood as shown in FIGS. 36,37,38. Strips of wood of sufficient size to provide designed flanged support to the specific member are centrally notched to define a groove of specific width and depth to fit onto the extended center layer 4 as shown in FIGS. 36,37,38. The structural flange may be glued, stapled and/or pinned to center layer 4. It will, of course, be understood that the roofing system described herein, utilizing a flat structural support member and roofing panels, may be adapted to be used as a suspended flooring system as well.

The top panel element 11 of a roofing panel may have a waterproof material affixed to it prior to installation. Waterproof material such as steel, aluminum, plastic, wood, rubber, asphalt, cement, or like materials may be applied directly to the panel element by gluing, stapling, nailing, or other appropriate fastening means. Depending on the waterproof material used, and the amount of overhang of the material about the perimeter of the roofing panel, additional waterproof materials may have to be applied in the field about the areas of the structural support members. A drywall or like plaster material, or other appropriate finishing materials, can be applied to the bottom panel element 12 of the roofing panel by any suitable attachment method. For purposes of illustration, FIG. 18 shows an appropriate layer of waterproofing material 11*a* adhered to the top panel element 11, and an appropriate finishing layer 12*a*adhered to the bottom panel element 12.

It will also be appreciated that plastic or metallic electrical and/or other utility boxes may be installed within the roofing panel by securing the boxes directly to the panel elements. Conduits for wiring and other utilities may be secured to the panel elements, allowing for clear passage between the mounted boxes and the end of the roofing panel. Conduits installed in other roofing panels would then be installed to align with the conduits and adjoining roofing panels.

It will be appreciated that the panels 2 of the roofing system just described can be assembled or disassembled by use of a single wrench. Accordingly, labor intensity is reduced, with the work effort being readily adapted to semiskilled labor.

It is also contemplated as a portion of the instant invention that each structural support member and roofing panel may be color coded and numbered in a sequential numbering order to facilitate the assembly of the roofing and/or flooring system so employed.

Figure 39:
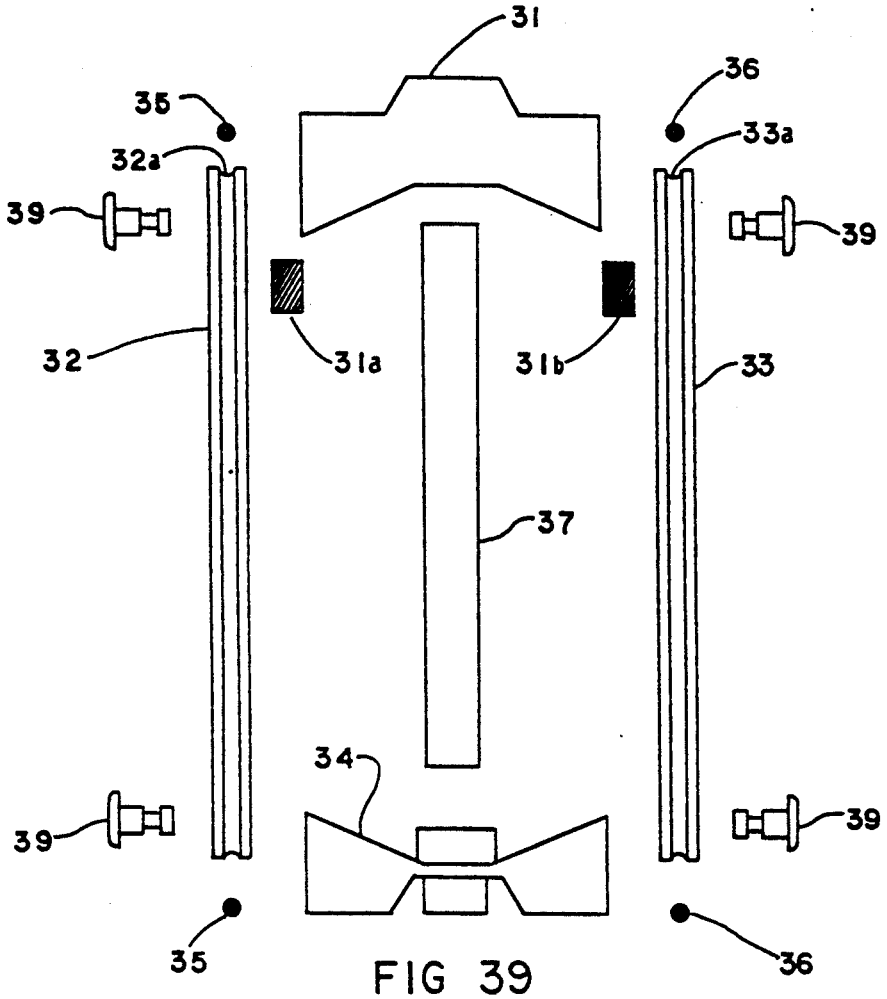
FIG. 39 is an exploded end view of the building block according to the invention, without insulation.
Figure 40:
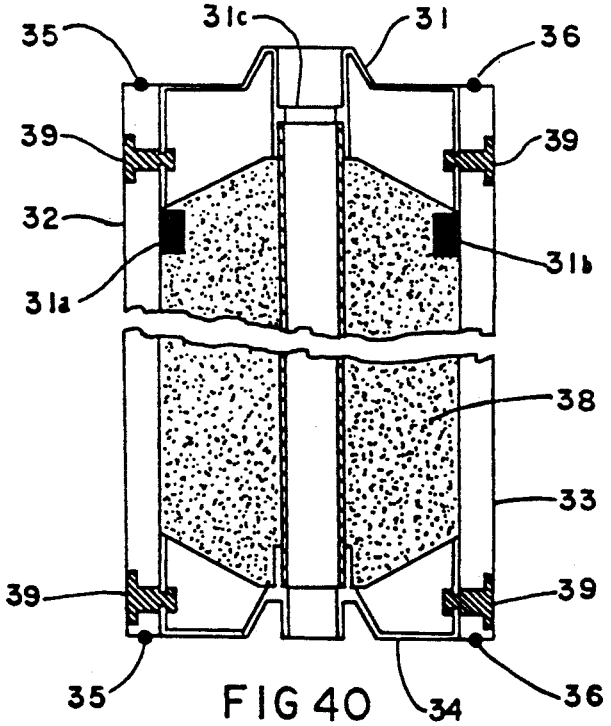
FIG. 40 is a partial section of the building block according invention.

FIGS. 39 and 40 illustrate a modular, pre-insulated, pre-finished structural building block comprised of structural elements 32 and 33, insulating element 38, upper structural element retainer 31, lower structural element retainer 34, fastening rod conduit 37, element retainer fasteners 39, upper structural retainer supports 31*a*, 31*b*, and seals 35,36. The structural elements 32,33 are preferably of plywood, pressed particle board, masonary, plastic, stone, clay, or other suitable material for carrying a compressive load. Facing elements and vapor barrier are not shown. Element retainer fasteners 39 as shown in FIGS. 39,40,47, and 48 are made of engineered thermal plastic and formed in a thermal injection mold. Element retainer fasteners 39 are inserted into holes drilled into structural elements 32,33 as shown in FIG. 40. The holes are ½" diameter with a ⅞" diameter × ⅛" deep counter bore. The upper holes 32*b* and 33*b* are drilled on centerlines ⅞" down from the top edge of a structural element and 6" in from the edge of each side of a full size block. The lower holes 32*c* and 33*c* are drilled on centerlines ⅝" up from the bottom edge of a structural element and 6" in from the edge of each side of a full size block. The structural element retainers 31 and 34 are made of the same material as the element retainer fasteners 39. The round portion of the formed opening 34*c* located on each end of a lower structural element retainer 34 as shown in FIG. 46 are placed over the protruding portions of the lower element retainer fasteners 39 as shown in FIG. 40 and the slotted portion of the retainer is slid over and locked onto portion 39*a* of the retainer fastener 39.

Wood supports 31*a* and 31*b* are secured by gluing and mechanical fasteners to structural elements 32 and 33 respectively, at a position directly below the lowest most level of the upper structural element retainers 31. Wood supports 31*a* and 31*b* interact directly with the structural elements 32 and 33 to resist shear force on the upper element retainer fasteners 39 when pressure is applied to structural element retainer 31 when securing a building block during the construction of a wall.

A ½" long portion of a steel or plastic fastening rod conduit 37 as shown in FIGS. 39 and 40 are placed into the formed cavity 34*b* of a lower structural element retainer 34 as shown in FIGS. 40 and 44. The round portion of the formed opening 31*b* located on each side of the upper structural element retainer 31 as shown in FIG. 42 are placed over the protruding portions of the upper element retainer fasteners 39 as shown in FIG. 40 and simultaneously the slotted portion of the retainer is slid over and locked by snap fitting onto portion 39*a* of the retainer fastener 39 and the upper ½" portion of the fastening rod conduit 37 is placed into the lower formed cavity of the upper structural element retainer 31 as shown in FIG. 40. When the insulating element 38 as shown in FIG: 40 is placed within the block cavity, all the connecting elements are bonded together.

Prior to the assembly of the block, the perimeter edges of the structural elements 32,33 were formed or run through a router and given a ⅛" wide × 1/16" deep rounded groove 32*a*,33*a* as shown in FIG. 39. After the block is assembled, a ⅛" diameter elastomer cord 35,36 is glued into the structural element grooves as shown in FIGS. 40 and 50 providing a double seal along the entire perimeter of the block.

The fastening rod 40 as shown in FIG. 49 is constructed of a stamped steel attachment head and ⅜" diameter rod threaded on both ends. The attachment head is comprised of retaining washer 40*d*, body 40*c*, and hex head 40*b*. The center of the body is drilled and tapped to accommodate one end of the rod. One end of the rod screws into the lower portion of the head directly below the retaining washer 40*d*. The entire fastening rod could be stamped in one piece and threaded as required.

During the assembly of a wall, a fastening rod 40 is placed into cavity 31*a* of an upper structural element retainer and the bottom threaded portion of the rod 40*e* is screwed into the head 40*a* of the adjacent fastening rod or anchor. The retaining washer 40*d* is tightened against a shoulder 31*c* formed within the upper structural element retainer 31 as shown in FIG. 40. In addition, during wall assembly, the round protruding portion 34*a* of the lower structural element retainer, of an upper adjoining block, is inserted over the upper most portion of an in place fastening rod and into the cavity 31*a* of the upper structural element retainer of the lower adjacent block.

The anchor plate as shown in FIG. 52 consists of an extruded aluminum casing 42 and retainer support 41. The retainer support 41 is made of the same material as the structural element retainers. The retainer support 41 slides into the casing 42 and is positioned on 12" centers.

The same stamped steel attachment head affixed to the the top of the fastening rods is utilized as an anchor support. The attachment head 43 is secured within the retainer support by a standard ⅜" bolt. The retaining washer 40*d* of the attachment head 43 is positioned against a formed shoulder 41*a* inside the retainer support 41 as shown in FIG. 53. The anchor plate is secured to a foundation through the use of anchor bolts 44 which are attached to every third or fourth attachment head 43 as shown in FIG. 53. A hole is drilled into the foundation to accommodate the anchor bolts and an epoxy cement or other material is used to secure the anchor bolts in place.

Additional structural element retainers and conduits may be placed within a building block during assembly of the block. After a wall is erected and before a top plate is secured in place, case hardened steel rods, as long as the wall is high, can be inserted into the wall through the extra structural element retainers. The top of the case hardened rods would be secured to a top plate, and the result would be a security wall.

From the foregoing, it can be appreciated that the invention is adapted to attain all the objects previously set forth herein, together with other advantages which are inherent and obvious from the apparatus and technique presented above. It is to be understood that certain features and subcombinations are of utility and it is recognized that variations and modifications may readily occur to those skilled in the art. Accordingly, while in accordance with the patent statutes only the best mode and preferred embodiment of the invention has been presented and described in detail, it is to be understood that the invention is not limited thereto or thereby. For an appreciation of the true scope and breadth of the invention, reference should be had to the following claims.

What is claimed is:

1. A roofing system, comprising:

a plurality of aligned support members in spaced apart relation to each other; and a plurality of roof panels received between adjoining support members, each said roof panel comprising:

a top panel; and a bottom panel spaced from and parallel to said top panel and overhanging said top panel along parallel sides thereof, said top and bottom panels being of the same length and longitudinally offset with respect to each other;

wherein said support members have panel support elements extending longitudinally therealong, said support elements receiving said roof panels, side support members extend down from opposite side edges of said top panel, said side support members being received and supported by said support elements, conduits extend between said side support members of each said roof panel, fastening rods extend through said conduits and said support members, said fastening rods of each said roof panel making securing engagement with an adjoining roof panel, each of said fastening rod has a first end which is externally threaded, and a second end with is internally threaded, and roof panels between a first pair of support members are offset with respect to roof panels between pairs of support members on each side thereof.

2. The roofing system according to claim 1 wherein said conduits receive a plurality of retainers, opposite ends of each said retainer being connected to said top and bottom panels.

3. The roofing system according to claim 2 wherein said top and bottom panels receive a plurality of fasteners, one fastener in engagement with an end of an associated retainer.

4. The roofing system according to claim 3 wherein an area defined between said top and bottom panels is filled with insulating foam, encompassing said conduits and retainers.

5. The roofing system according to claim 1 wherein said top panels are covered with a weather sealing material, and said bottom panels are covered with a decorative finishing material.

6. The roofing system according to claim 1 wherein each said support member comprises an inner layer sandwiched between a pair of outer layers.

7. The roofing system according to claim 6 wherein said inner layer comprises a flange of a steel beam, said outer layers being of wood construction and sandwiching a portion of said flange, a wood filler strip abutting said flange and coextending with said outer layers, said outer layers and wood filler strip defining a plane at outer edge surfaces thereof.

8. The roofing system according to claim 6 wherein said inner and outer layers are of wood construction, each formed of linear pieces of material spliced together to form desired lengths, splices in each of said layers being at different longitudinal points along the length of the support member formed thereby.

9. The roofing system according to claim 6 wherein said sandwiched inner and outer layers are capped along an edge thereof by a structural wood flange, said flange being grooved to receive said inner layer.

10. A roofing system comprising:

a plurality of aligned support members, each having support elements extending longitudinally therealong;

a plurality of roof panels maintained between aligned pairs of said support members and supported by said support elements; and fastening rods interconnecting roof panels maintained between a first aligned pair of support members with roof panels maintained between second and third aligned pairs of support members on either side of said first aligned pair of support members;

wherein said roof panels and said support members have aligned conduits passing therethrough, receiving said fastening rods, and said roof panels between said second and third pairs of support members are aligned with each other and offset with respect to roof panels between said first pair of support members.

11. The roofing system according to claim 10 wherein said roof panels comprise a top panel maintained in parallel relation to a bottom panel, said top panel being wider than said bottom panel and overhanging side edges of said bottom panel, said top and bottom panels being of the same length, but offset with respect to each other.

12. The roofing system according to claim 11 wherein said top and bottom panels are secured to opposite ends of a plurality of retainers, said retainers received upon said conduits passing through said panels.

13. A roofing system, comprising:

a plurality of aligned support members in spaced apart relation to each other; and a plurality of roof panels received between adjoining support members, each said roof panel comprising:

a top panel; and a bottom panel spaced from and parallel to said top and panel and overhanging said top panel along parallel sides thereof said top and bottom panels being of the same length and longitudinally offset with respect to each other;

wherein said support members have panel support elements extending longitudinally theralong, said panel support elements receiving said roof panels, side support members extend down form opposite side edges of said top panel, said side support members being received and supported by said support elements, conduits extend between a said side support members of each said roof panel, and each said support member comprises an inner layer sandwiched between pair of outer layers, said inner layer comprising a flange of a steel beam, said outer layers being of wood construction and sandwiching a portion of said flange, a wood filler strip abutting said flange and coextending with said outer layers, said outer layers and wood filler strip defining a plane at outer edge surfaces thereof.

* * * * *